US005933873A

United States Patent [19]

Curran et al.

[11] Patent Number: 5,933,873

[45] Date of Patent: Aug. 10, 1999

[54] IDENTIFICATION DISPLAY SYSTEM AND METHOD THEREFOR

[75] Inventors: Peter M. Curran, Burlington; Jake Burton Carpenter, Stowe; Susan Poersch, Shelburne, all of Vt.

[73] Assignee: The Burton Corporation, Burlington, Vt.

[21] Appl. No.: 08/780,382

[22] Filed: Jan. 8, 1997

[51] Int. Cl.[6] ..... A41B 1/00

[52] U.S. Cl. ..... 2/247; 2/69; 2/108

[58] Field of Search ..... 2/247, 245, 250, 2/108, 102, 115, 69, 85, 93, 94, 95, 81, 82, 171, 227, 228, 211; 40/586, 124.01, 1.5, 124.06, 329, 636, 640

[56] References Cited

U.S. PATENT DOCUMENTS

| | | | |
|---|---|---|---|
| 2,577,717 | 12/1951 | Stevens | 40/329 |
| 2,986,743 | 6/1961 | Eilen | 40/586 |
| 3,055,133 | 9/1962 | Anderson | 2/102 |
| 3,193,842 | 7/1965 | Bell | 2/94 |
| 3,662,480 | 5/1972 | Gilson, Jr. et al. . | |
| 4,389,801 | 6/1983 | Sharrock et al. | 40/586 |
| 4,602,390 | 7/1986 | Morera et al. | 2/247 |
| 4,625,337 | 12/1986 | Zahn | 2/94 |
| 4,650,219 | 3/1987 | Sigman | 40/586 X |
| 4,969,214 | 11/1990 | Cohen | 2/102 |
| 5,127,105 | 7/1992 | Sacks | 2/102 |
| 5,127,545 | 7/1992 | French . | |
| 5,173,968 | 12/1992 | Fox | 2/108 |
| 5,388,739 | 2/1995 | Gargan . | |
| 5,421,032 | 6/1995 | Murphy | 2/247 |
| 5,452,479 | 9/1995 | Mostert | 40/329 |
| 5,548,847 | 8/1996 | Spicijaric | 40/329 |

OTHER PUBLICATIONS

Translation of Utility Model Technology Assessment, Utility Model No. 10–000012.

Japanese Utility Model Laid–open Applicant No. 56–123826, Date of application: Feb. 18, 1990, Application: Kikuchi Takayuki, Title of Invention: Tie.

Japanese Utility Model Laid–open Application No. 57–185722, Date of application: May 19, 1981, Applicant; Murayama Toshitugu, Title of Invention: Transillumative Pocket.

Japanese Utilit Model Registered No. 3026566, Date of Registration: Apr. 24, 1996, Applicant: Sogo Keibi Hosho Kabushiki Kaishya, Title: Garment with means for indicating an information of identity card.

*Primary Examiner*—Gloria Hale

*Attorney, Agent, or Firm*—Wolf, Greenfield & Sacks, P.C.

[57] ABSTRACT

An identification display system including a hidden pocket having an opening through which an identification, such as a card, season pass, lift ticket or the like may be viewed, once revealed. The pocket may be located on the inside of a garment, such as a jacket, or on an inner garment such as pants which are covered by an outer garment, such as a jacket, so that when the bottom of the jacket or outer garment is flipped up, the identification is visible.

12 Claims, 5 Drawing Sheets

IDENTIFICATION DISPLAY SYSTEM AND METHOD THEREFOR

BACKGROUND OF THE INVENTION

1. Field of the Invention

This invention relates to an identification display system and method therefor and, more particularly, to a garment such as a jacket with a hidden pocket for holding an identification which may be readily displayed.

2. Background of the Invention

Oftentimes, a season pass or lift ticket is hung by a chain from a skier or snowboarder's neck. When requested to show a ticket or pass, prior to boarding a lift for example, the enthusiast may have to remove her glove or mitten—commonly too bulky to provide the dexterity to operate the main jacket zipper—remove another article like a scarf or neck warmer just to access the zipper, and then unzip the coat which may expose a non-weather proof layer of clothing or even skin to the elements. Weather conditions, be it snow, wind, or simply cold may exacerbate the discomfort. All of this inconvenience is required simply to display a pass to ride the chair lift.

Pass holders are available to minimize these problems. Representative is an armband which is secured around the bicep area of a jacket. The pass is located on the outer surface of the armband so that it is immediately visible to the operator checking tickets in the lift line. A disadvantage of the armband pass holder is that personal information provided on the identification, perhaps including one's name and address, and even a picture, are displayed at all times. Many people are reluctant to continually have displayed such personal information. Because the armband is on the exterior of the jacket, snow, water, or ice may invade the pass chamber, damaging or weakening the pass or causing the information thereon to fade or blur.

SUMMARY OF THE INVENTION

The present invention is a selectively revealable identification display system for holding a season pass, chairlift ticket, card or other identification. A pocket is located on the inside of a garment, such as a jacket, or on a pair of pants covered by a jacket, or at such other location which lends itself to being revealed by the wearer when desired, but otherwise is shielded from view. The pocket is sized to receive the card and includes an entrance for slipping the card into the pocket and an opening through which the emplaced identification may be viewed. A protective, transparent window may be provided over the opening. A closure mechanism may be provided to releasably seal the entrance and a tab may be provided to facilitate opening the pocket prior to depositing or removing the identification.

In one embodiment, the pocket is provided on the gaiter of a jacket and includes an opening through the gaiter which is covered by a transparent sheet or window and a backing which are joined together to form the pocket. Hook and loop fasteners may be provided on an edge, such as the top, of the pocket to close the entrance after the card has been emplaced. A strip of fabric or other tab may be included to encourage opening of the fastener system. With this arrangement, the hidden identification, such as a card, ticket or season pass may be exhibited simply by lifting up the skirt or lower portion of a jacket to reveal the pocket.

In another embodiment, the pocket is constructed in a fashion similar to the first embodiment but is located on the inside of the jacket rather then on the gaiter. Again, simply flipping up the jacket bottom will exhibit the card pocket. In this embodiment, it may be preferable to invert the card so that it appears right side up when displayed.

It is among the general objects of the present invention to provide a pocket for holding an identification which may be displayed by the wearer as desired.

A further object of the present invention is to provide a simple and fast way to display the identification.

Another object of the present invention is to provide a pass pocket which is substantially protected from inclement conditions.

These and other objects and features of the present invention will be better understood and appreciated from the following detailed description of two basic embodiments thereof, selected for the purpose of illustration and shown in the accompanying drawings. It is to be understood that the drawings and textual description thereof are designed for the purpose of illustrating and explaining embodiments of the invention only and are not intended as a definition of limits of the invention.

BRIEF DESCRIPTION OF THE DRAWINGS

The foregoing and other objects and advantages will be appreciated more fully from the following drawings in which.

DETAILED DESCRIPTION OF THE PREFERRED EMBODIMENTS

Figure 1:
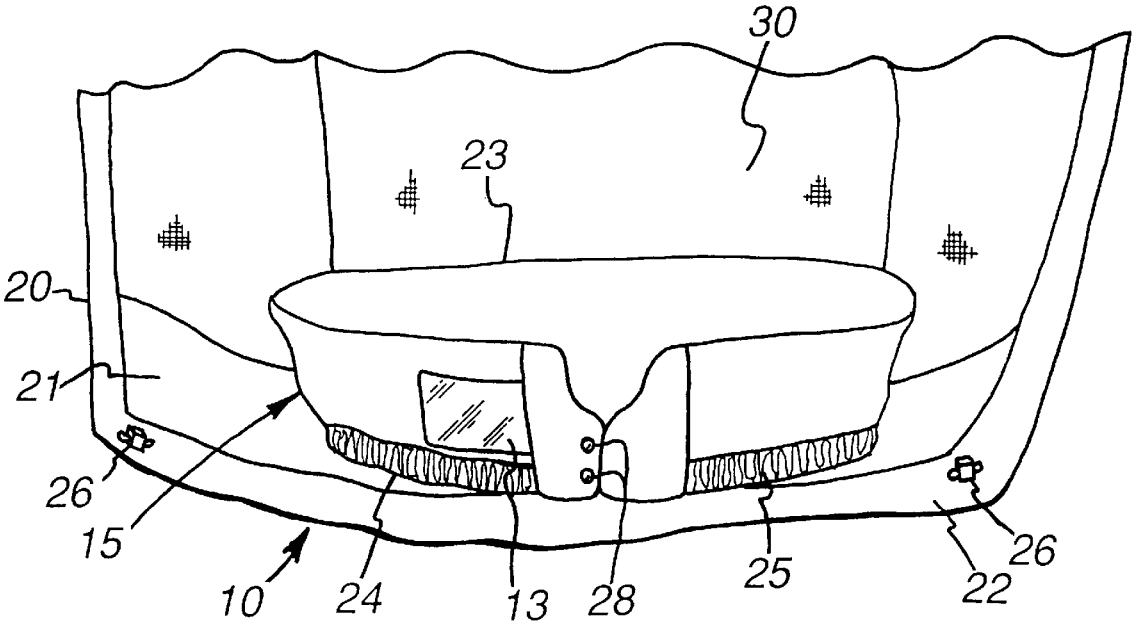
FIG. 1 is a perspective view showing the pass pocket location of the first embodiment of the present invention.
Figure 2:
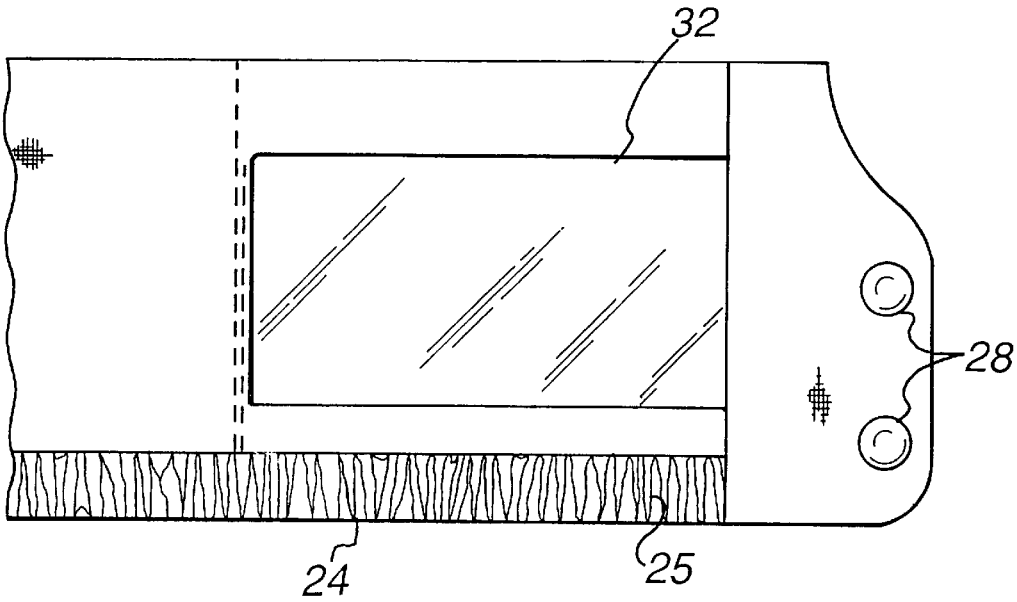
FIG. 2 is a detailed view of the pass pocket location of FIG. 1.
Figure 3:
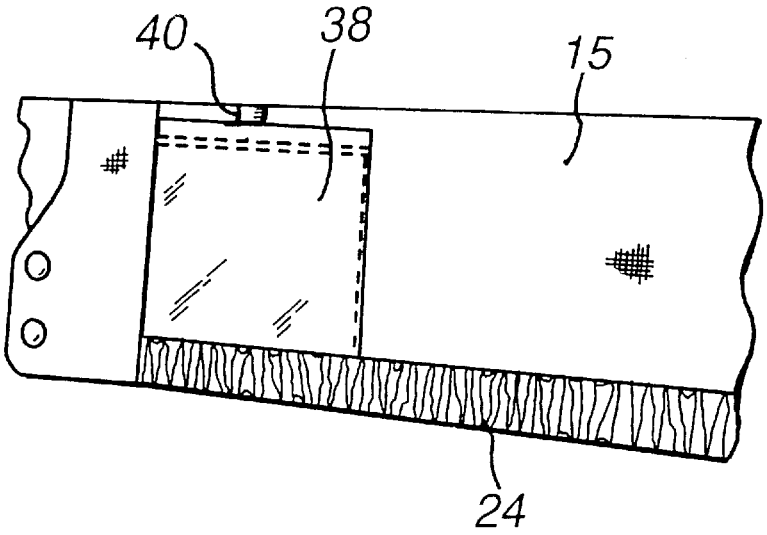
FIG. 3 is a rear perspective view of the invention shown in FIG. 2.

FIGS. 1–4 illustrate a first embodiment of a selectively revealable identification display system 10 which includes an identification pocket 13 located on a gaiter 15 of a jacket 20. The gaiter 15 is secured to the inside of the jacket 20 generally facing the jacket skirt 21. For purposes of this description, the jacket skirt 21 is the portion of the jacket 20 including and above the lower edge or hem 22 and includes, but is not limited to, jacket styles which extend below the user's waistline.

The gaiter 15 may be attached along an upper edge 23 to the jacket 20 and may have an elastic band 25 which extends substantially the length of its lower edge 24. Free ends of the gaiter 15 may be joined by snaps 28 to close the gaiter 15 snugly around the wearer. The elastic band 25, like the drawstring 26 running the length of the hem 22, mitigates snow, wind, and cold air from entering the interior 30 of the jacket from below.

Figure 4:
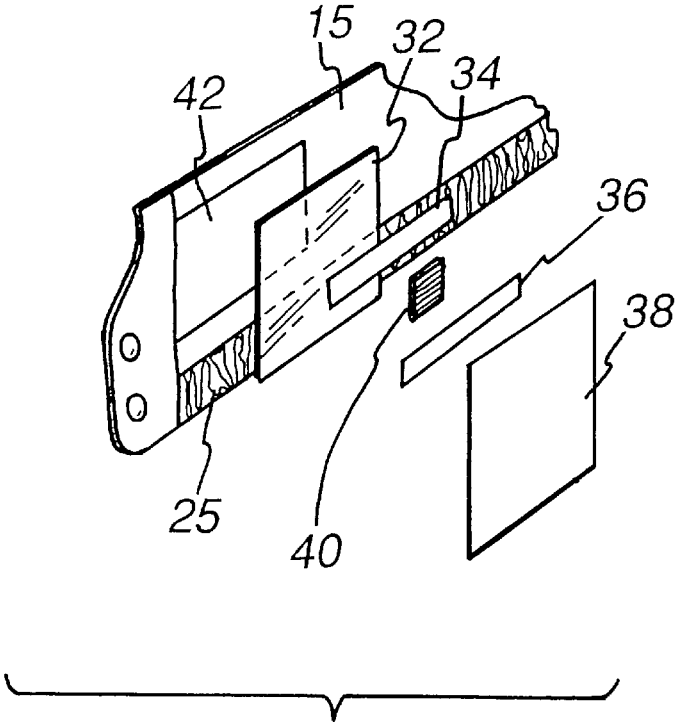
FIG. 4 is an exploded view of the invention as shown in FIG. 3.
Figure 5:
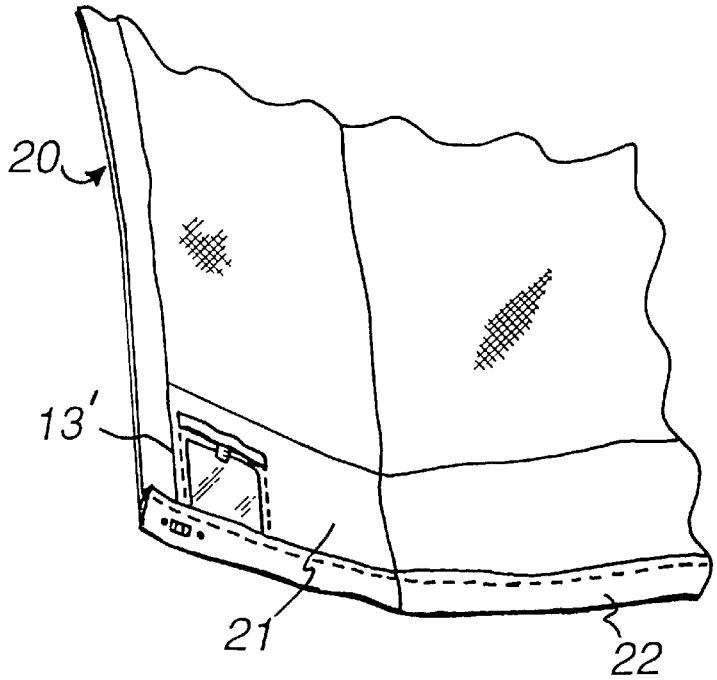
FIG. 5 is a perspective view of the second embodiment of the present invention.
Figure 6:
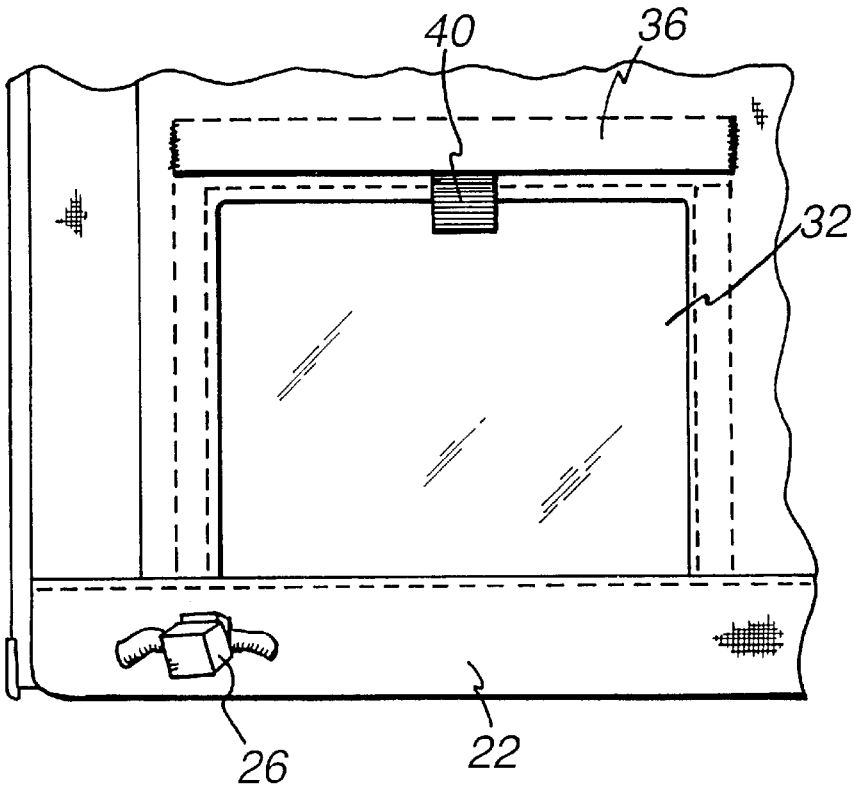
FIG. 6 is a detailed view of the invention shown in FIG. 5.
Figure 7:
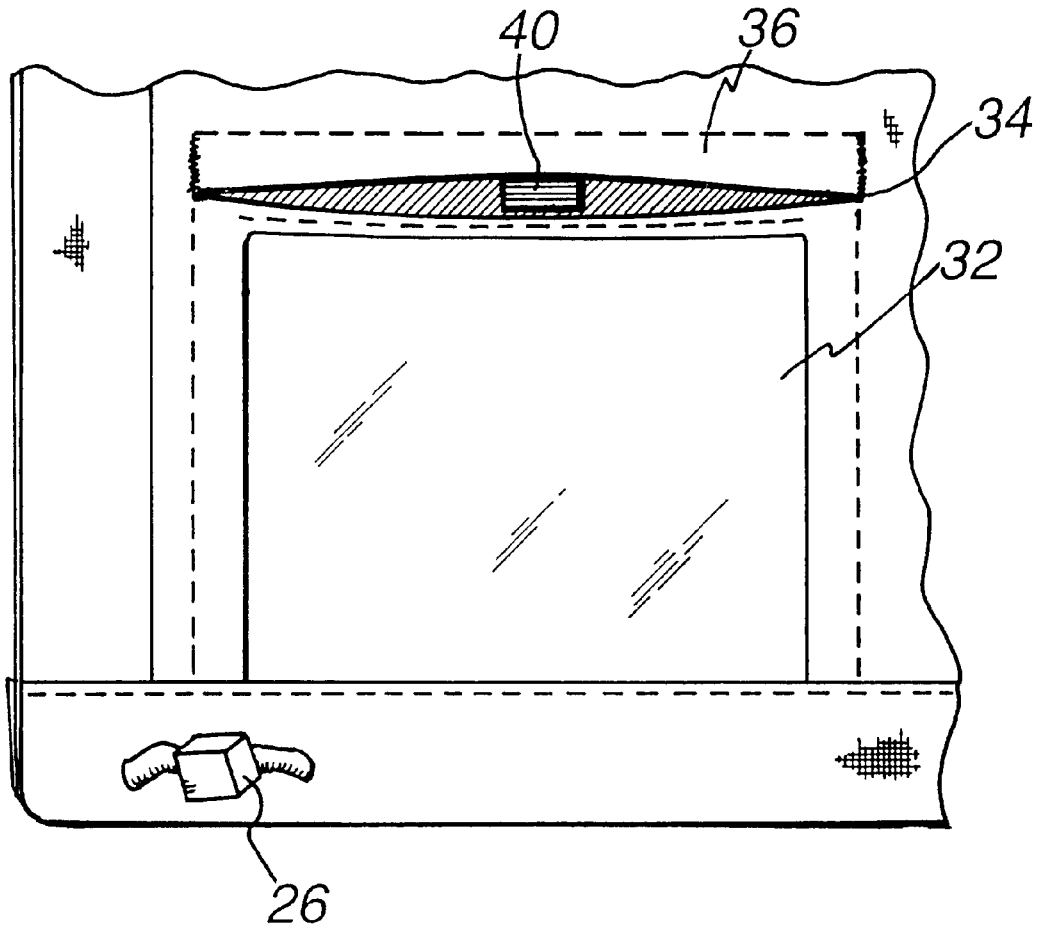
FIG. 7 is a detailed view of FIG. 6 with the pass pocket in the open position.
Figure 8:
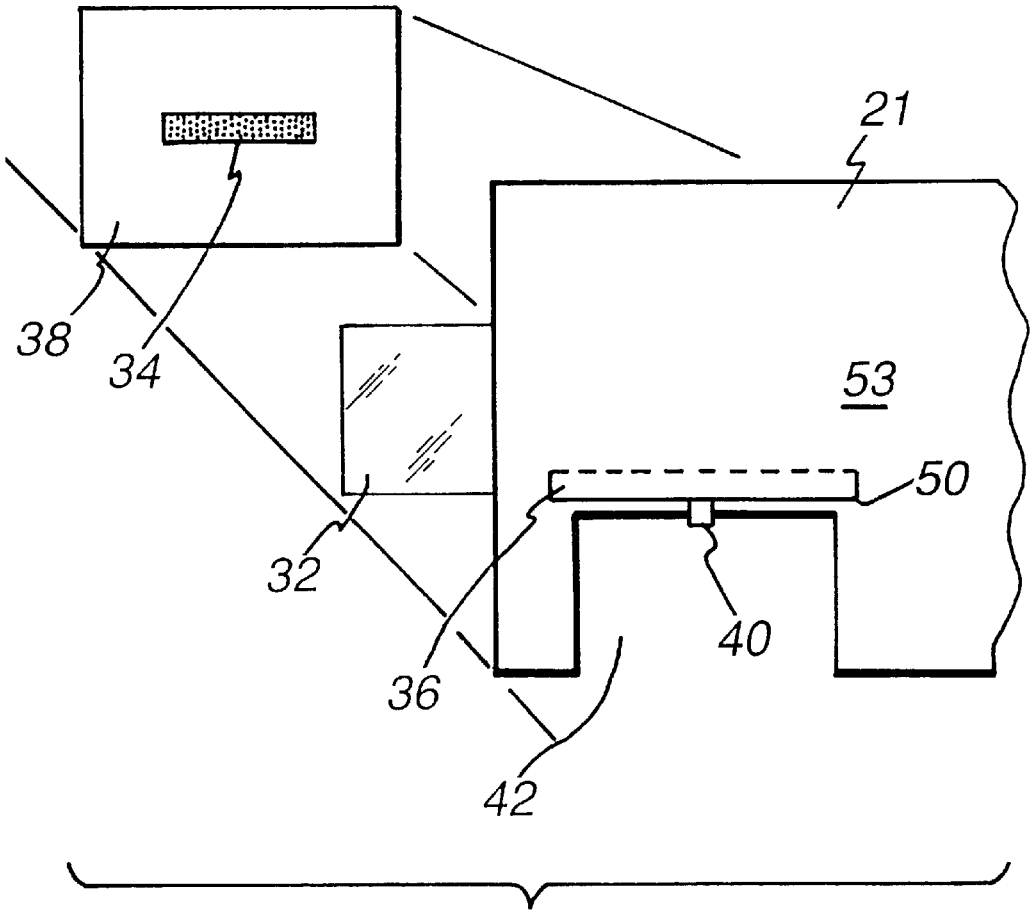
FIG. 8 is an exploded view of the second embodiment of the present invention.

As best shown in FIG. 4, an embodiment of the pass pocket 13 includes an opening 42 through which the identification may be observed, a transparent window 32, such as a vinyl sheet, for covering the opening and protecting the identification when positioned in the pocket, and a back wall 38 of the pocket 13 which is preferably formed of a material such as taffeta. A hook and loop fastening system, such as Velcro®, comprising a loop or female strip 34 aligned for mating with a hook or male strip 36, may be employed to releasably open and close the entrance to the pocket. Finally, a pull tab 40, preferably of nylon webbing, for opening the entrance to the pocket may be provided. Generally, all the elements may be stitched or glued in position, although other fastening mechanisms may be employed as would be apparent to one of skill in the art.

In manufacturing the pocket 13, the opening 42 is cut in the gaiter 15. The window 32 may be slightly larger than the opening 42 and may be joined to the gaiter 15, such as by stitching, just beyond the perimeter of the opening 42. The opening 42 may be sized and shaped to exhibit a standard season pass which typically is approximately 3×5 inches. The opening 42, however, may be larger or smaller, have a different orientation than shown, or may have a different shape than the rectangle described herein. All of these variations are within the scope of the invention.

The loop and hook strips 34 and 36 are preferably arranged as described above with the male strip 36 facing away from the wearer to avoid catching on a clothing item such as a sweater. These elements 34 and 36, however, may be reversed if desired. Other arrangements for closing the entrance to the pocket, such as a zipper or snap fasteners for example, may be employed as would be apparent to one of skill in the art. The first strip 34 may be secured directly to the gaiter 15 or to both the window 32 and the gaiter 15. The second strip 36 may be stitched or otherwise secured to the back wall 38 in mating alignment with the first strip 34, and the tab 40 is preferably secured between the second strip 36 and the back wall 38. Finally, the back wall 38 is connected to the gaiter 15.

The pocket 13, which is generally defined by the perimeter connection, such as stitching, of the back wall 38 to the gaiter 15, is preferably larger than the opening 42, but not substantially larger so that the identification does not slide out of alignment with the window 32. Finally, access to the pocket 13 preferably is on the side of the gaiter 15 facing the user. Such an arrangement helps prevent snow and water from entering the pocket 13.

Operation of the identification display system 10 is simple. Pulling the tab 40 away from the gaiter 15 opens the pocket 13. The user inserts her pass in the pocket 13 with the necessary information visible through the window 32. When needed, the user simply flips up the bottom of her jacket, such as the skirt 21 or as much of the skirt 21 as necessary to display the pass.

Another embodiment of the present invention is shown in FIGS. 5–8. In these figures, like numbers are used for like elements described with the first embodiment. The primary difference between the first and second embodiments is the location of the pockets 13 and 13'. In the second 5 embodiment, the pocket 13' is preferably located on the front inside of the jacket 20 near the skirt 21. The construction of the pocket 13' is generally the same as the pocket 13 shown in the first embodiment with only slight modifications. Here, a slot 50 is cut into the inside lining 53 of the jacket 20. The strips 34 and 36 are secured in facing alignment at the slot 50, and a back wall 38 forms the rear of the pocket 13'. In this embodiment, the user also flips up the skirt 21 to display the pass or identification. However, because the pocket 13' is on the lining 53 of the skirt 21, the identification may be inverted so that when the skirt 21 is flipped up, the card is properly oriented.

Various changes and modifications and equivalents of the embodiments described and shown in the drawings may be made within the scope of this invention. For example, although the entrance to the pocket has been disclosed along the top edge, it also may be arranged along either side edge or on the bottom. Thus, it is intended that all matters contained in the above description or shown in the accompanying drawings are represented by way of example only and are intended to be interpreted in an illustrative and not in a limiting sense.

We claim:

1. A display system for an identification provided on a jacket garment which remains on the user during display of the identification, comprising:

a jacket garment having an interior and an exterior, said interior abuts and faces the user;

a pocket sized and shaped for receiving and holding the identification, such as a card, ticket, season pass or the like, located on said interior facing said user;

wherein said pocket has an opening on its face facing said user through which the identification is only visible when at least a portion of said exterior of said garment is adjusted to expose said opening on said interior.

2. A display system for an identification provided on a jacket garment which remains on the user during display of the identification, comprising:

a jacket garment having an interior and an exterior;

a pocket sized and shaped for receiving and holding the identification, such as a card, ticket, season pass or the like, located on said interior;

wherein said pocket has a coverable opening through which the identification is only visible when at least a portion of said exterior of said garment is adjusted to expose said opening on said interior; and wherein said pocket includes a transparent window for covering said opening.

3. The display system for an identification as set forth in claim 1 further including an entrance to said pocket.

4. The display system for an identification as set forth in claim 3 further including means for releasably opening and closing said entrance to said pocket.

5. The display system for an identification as set forth in claim 3 further including a tab for facilitating opening of said entrance.

6. A display system for an identification provided on a jacket garment which remains on the user during display of the identification, comprising:

a jacket garment having an interior and an exterior;

a pocket sized and shaped for receiving and holding the identification, such as a card, ticket, season pass or th like, located on said interior;

wherein said pocket has a coverable opening through which the identification is only visible when at least a portion of said exterior of said garment is adjusted to expose said opening of said interior; and wherein said jacket includes a skirt whereby lifting said skirt exposes the identification.

7. The display system for an identification as set forth in claim 6, wherein said pocket is located on said skirt.

8. The display system for an identification as set forth in claim 6, wherein said jacket further includes a gaiter, and said pocket is located on said gaiter.

9. A display system for an identification comprising:

an inner garment layer which is a jacket gaiter and an outer garment layer which is an exterior of a jacket;

a pocket sized and shaped for receiving and holding the identification, such as a card, ticket, season pass or the like, located on said inner garment layer which normally is shielded from view by said outer garment layer; wherein said pocket has an opening through which the identification is visible when only a portion of said outer garment is moved to reveal said inner garment layer.

10. A method of displaying an identification, such as a card, ticket, season pass or the like, comprising the steps of:

locating a windowed pocket on an inner garment layer relative to an outer jacket garment layer;

placing the identification in the pocket;

covering the windowed pocket by the outer garment layer; and moving only a portion of the outer jacket garment layer to display the identification through the windowed pocket.

11. A display system for an identification, comprising:

inner garment layer which is the exterior surface of a pair of pants and an outer garment layer which is an outer garment;

a pocket sized and shaped for receiving and holding the identification, such as a card, ticket, season pass or the like, located on said inner garment layer which normally is shielded from view by said outer garment layer; wherein said pocket has an opening through which the identification is visible when only a portion of said outer garment is moved to reveal said inner garment layer.

12. A display system for an identification as set forth in claim 1, wherein said pocket is further sized and shaped for holding the identification in a desired orientation.

* * * * *